US005293653A

United States Patent [19]

Filipponi

[11] Patent Number: 5,293,653

[45] Date of Patent: Mar. 15, 1994

[54] DEVICE FOR THE PRODUCTION OF STEAM FOR INSTALLING ON THE ROOF OF A STANDARD SHOWER BOX

[75] Inventor: Alberto Filipponi, Montefano, Italy

[73] Assignee: Sea di Filipponi A. & C. - S.n.c., Selva, Italy

[21] Appl. No.: 949,785

[22] Filed: Sep. 22, 1992

[30] Foreign Application Priority Data

Sep. 27, 1991 [IT] Italy ..... AN91A000034

[51] Int. Cl.[5] ..... A61H 33/06

[52] U.S. Cl. ..... 4/524; 4/533

[58] Field of Search ..... 4/524, 525, 533, 612, 4/614; 128/366, 367

[56] References Cited

U.S. PATENT DOCUMENTS

| | | | |
|---|---|---|---|
| 3,007,178 | 11/1961 | Altman et al. | 4/525 |
| 4,045,652 | 8/1977 | Janson | 4/524 |
| 4,370,543 | 1/1983 | Nemeth | 128/367 |
| 4,833,739 | 5/1989 | Sakakibara et al. | 4/524 |
| 5,142,713 | 9/1992 | Makool | 4/533 |

FOREIGN PATENT DOCUMENTS

| | | | |
|---|---|---|---|
| 48901 | 1/1989 | European Pat. Off. | 4/524 |
| 48908 | 8/1989 | PCT Int'l Appl. . | |

*Primary Examiner*—Ernest G. Cusick
*Attorney, Agent, or Firm*—Leonard Bloom

[57] ABSTRACT

A device for the production of steam for installing on the roof of a new or existing shower standard box, so as to transform a standard shower box into a sauna. The device has a compact box-shaped roof having a fan for forced air circulation and an instantaneous vaporizer supplied directly by the water source by means of a solenoid valve operated intermittently by a timer interlocked by two thermostats. The box-shaped roof is used together with a covering screen for closing the part of the box top which is not covered by the box-shaped roof itself.

8 Claims, 2 Drawing Sheets

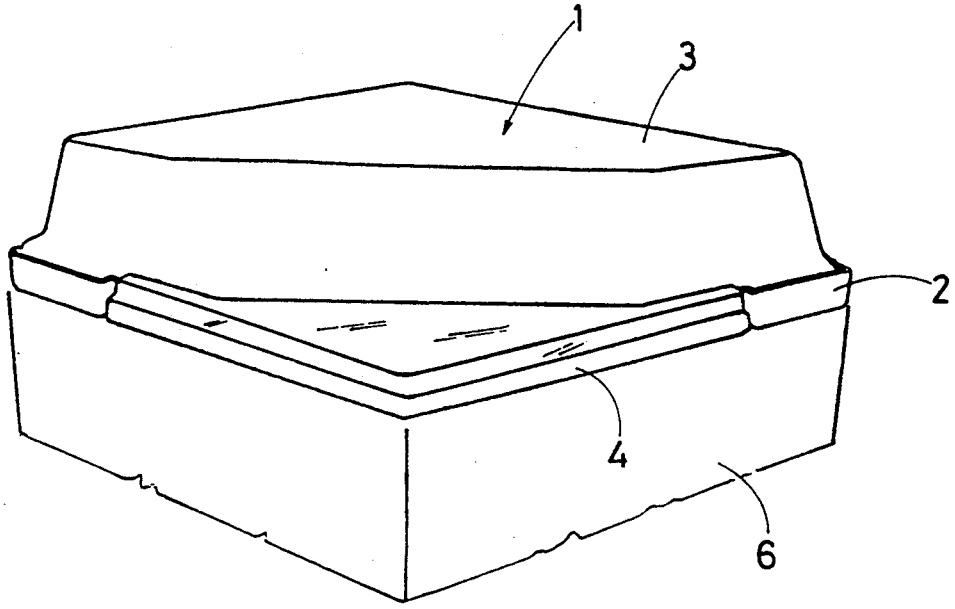
FIG. 1
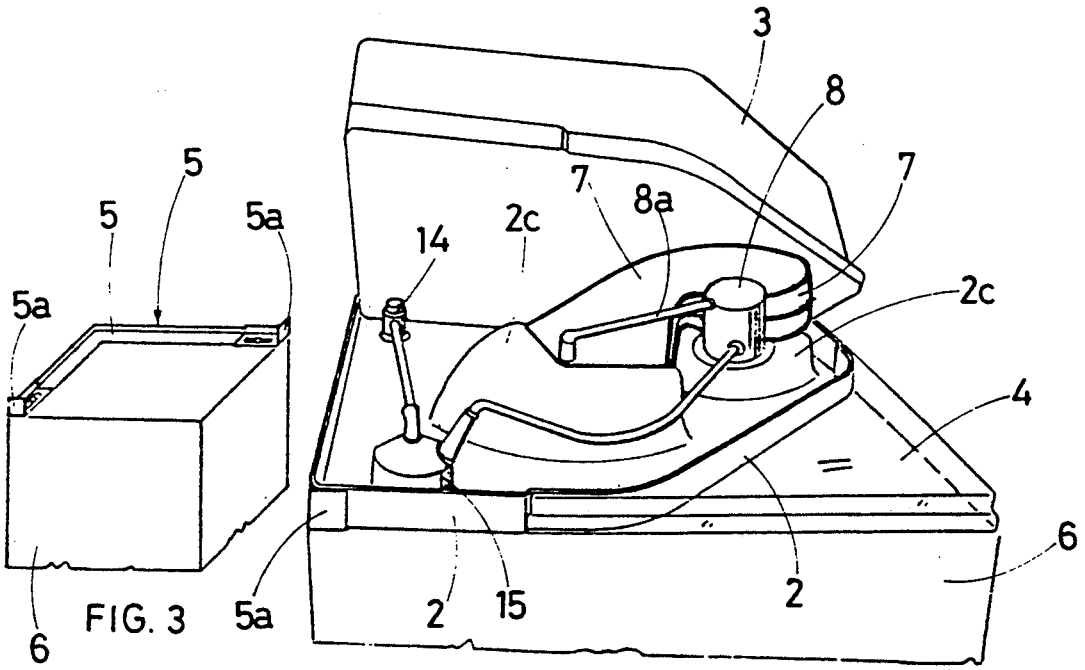

DEVICE FOR THE PRODUCTION OF STEAM FOR INSTALLING ON THE ROOF OF A STANDARD SHOWER BOX

This design patent concerns a device for the production of steam for installing on new or existing shower boxes, so as to transform a standard box into a sauna.

It is common knowledge that steam baths require a closed area so as to avoid the dispersion of steam.

A shower box with a roof is undoubtedly ideal for steam baths, above all in the home, thanks also to its compact sizes and low cost.

Currently, two types of devices are used in shower boxes for producing steam.

In one version of these devices, the steam producing device is held in an external knapsack type container outside the shower-box and connected to the latter by means of a steam and hot air supply pipe.

The steam forms in a boiler while both the water supply and draining of the water remaining on the bottom of the boiler, are manual.

Installing said devices in a standard bathroom involves both aesthetic and practical problems since not always is there enough space to install the equipment in question; moreover, the production of steam is quite lengthy.

The second version involves a device for the production of steam mounted in the roof, shower tray or on the back wall of special shower boxes which are designed with unusual compartments for housing and concealing the components of the steam production device which is consequently an integral part of these shower boxes with sauna.

These compartments generally increase the overall sizes of the shower boxes, to the extent that their use is rather limited because of the considerable space required for installation.

The design purpose is the realization of a device for the production of steam in a standard shower box, whose shape and operating mechanism make it possible to install the same in the roof of any standard shower box.

The peculiarity of the device according to the invention is that no modification or adaptation is required to the shower boxes on to which it is installed, so that it can even be installed on existing boxes.

The device in question, can therefore be considered as a standard accessory for shower boxes, with its own autonomous operation and structure, regardless of the shape and size of the shower box on which it is to be installed.

The device according to the invention consists of a box shaped roof having a reduced surface area housing the steam producing device which consists of an instantaneous vaporizer supplied directly from the water mains thanks to the intervention of a solenoid valve operated intermittently by a timer interlocked by two thermostats.

An absolute innovation which has never been adopted in shower and sauna boxes before, is the use of a small instantaneous vaporizer replacing the bulky boilers generally installed to date; this has made it possible to simplify and reduce the sizes of the steam production and forced air circulation system very considerably , which, thanks to the device according to the invention, may now be housed in a box-shaped roof having a surface area almost half the size of even the smallest shower trays on the market, to the extent that said box-shaped roof must be used together with a covering screen, having different sizes as necessary, which covers the part of the shower box top which is not covered by the roof.

The device according to the invention offers many advantages.

Firstly, the use of said device does not require modification or adaptation of the shower box on which it is to be installed, nor does it involve structural work in the bathroom where the box is installed, since said device requires only a connection to the water mains and a socket for plugging in to the mains, both of which are readily available in any bathroom.

Secondly, the use of an instantaneous vaporizer considerably reduces steam production times with respect to those required by the boilers currently used.

For major clarity, the description continues with reference to the enclosed drawings which are intended for illustrative purposes and not in a limiting sense, whereby:

FIG. 1 is a view of the box-shaped roof according to the invention installed on a standard shower box, of which two sections of wall are presented in diagram form;

FIG. 2 is a view of the box-shaped roof according to the invention with the roof lifted in order to show the steam production and forced air circulation system, laden with steam, inside the shower box;

FIG. 3 is an axonometric view of the structural section which supports the box-shaped roof according to the invention;

Figure 4:
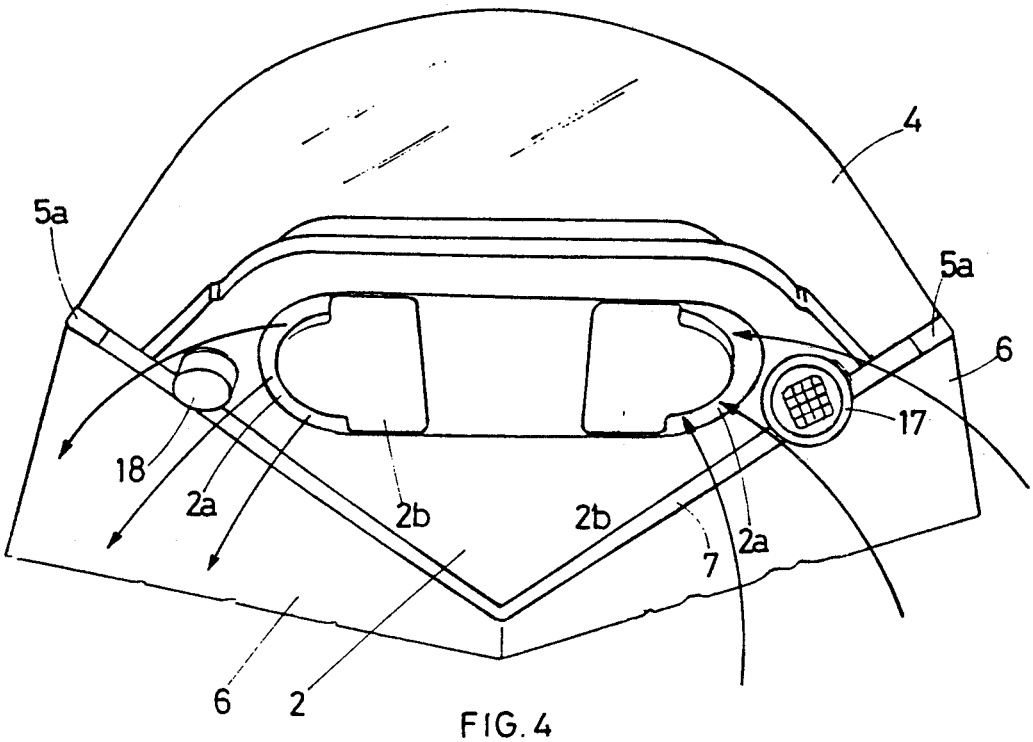
FIG. 4 is a view of the roof according to the invention seen from the interior of the shower-box.

With reference to FIGS. 1, 2 and 4, the steam production device according to the innovative principles of the invention consists of a box-shaped roof (1) having a base (2) and a hollow lid (3) for housing all components for the steam production and forced air circulation system in the shower-box and for the automatic control of the operating cycle.

The base (2) has two identical and opposed semi-circular openings (**2*a***), an output and input respectively, for the forced recirculation of the steam laden air.

These openings feature lids (**2*b*) which partially cover the wide bottom opening of two slots (2*c*) on the interior face of the base (2**).

The roof (1) has a standard shape and sizes and has no relation to the shape and sizes of the underlying shower box on which the device is installed.

Said roof (1) can be realized, for example, with glass fibre reinforced acrylic.

In a preferred embodiment, the horizontal section of the roof (1) has approximately the shape of an isosceles rectangular triangle so that it can not in itself completely cover the top of standard quadrangular or circular section shower box.

For this purpose, the roof (1) is used together with a covering screen (4) whose external shape and sizes vary according to the shape and sizes of the shower-box on which the device is installed, as illustrated by way of example in FIGS. 1 and 4 where two of the many shapes that this screen may have, are illustrated.

In FIG. 1, the screen (4) is almost triangular and ideal for covering a quadrangular section box, while in FIG. 4 the screen has an approximately circular shape, ideal for covering boxes with a circular section.

Said screen (4) may for example be realized in transparent material to provide more light inside the shower box.

In order to support the roof (1) and the screen (4), a structural section (5) is fixed to the wall, which, together with the top railing of the shower box (6) forms a perimeter support frame for the base (2) of the roof (1) and for the external edges of the screen (4).

The structural section (5) features two end adjusting parts (5*a*) which permit adjusting the length, so as to adapt it to the transverse sizes of the underlying shower box.

The structural section (5) consists of two perpendicular arms at the ends of which the end adjustment parts (5*a*) are fitted.

Figure 5:
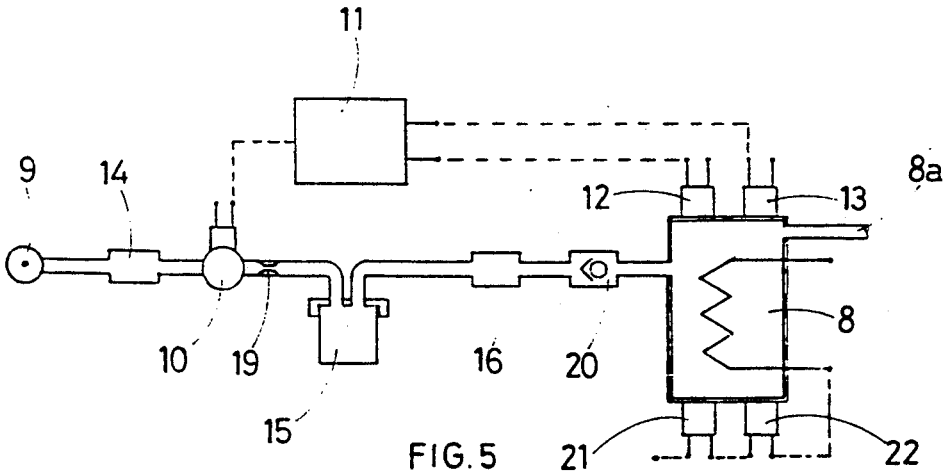
FIG. 5 is a diagram of the steam production device.

With particular reference to FIGS. 2 and 5, the steam production and forced air circulation system in the shower box (6) is now described.

It should firstly be mentioned that forced air circulation inside shower boxes is generally obtained by means of a suction fan housed in a channel (7) positioned on the interior face of the base (2), which connects the slots (2*c*).

The steam is introduced into the outlet of this channel (7) by means of a supply pipe (8*a*) which connects this section to the vaporizer (8).

It should be noted that the suction fan (not shown in the drawing), the electrical heating elements for heating the air (not shown in the drawing) and the instantaneous vaporizer (8), with relevant supply pipe (8*a*) are all preassembled and supported by the channel (7) which, when the device is mounted, is simply fixed to the base (2) as a connection between the above slots (2*c*).

The steam production device consists of an instantaneous vaporizer (8) supplied directly from the water mains (9) by means of a solenoid valve (10) operated intermittently by a timer (11) interlocked by two thermostats (12 and 13).

Said timer (11) is designed to supply two intermittent operating modes, with active phases of different duration. A filter (14) which stops impurities from reaching the solenoid valve and the instantaneous vaporizer (8) is installed before the solenoid valve (10).

Instantaneous vaporizers have very small passageways so that the formation of scale, which would jam these passageways, must absolutely be prevented.

The problem can be resolved by the total demineralization of the water used.

Demineralizing the water not only prevents the formation of scale in the passageways of the instantaneous vaporizer (8), but also prevents the formation of any sludge present in the steam which would leave residues on the surface of the shower box, thereby making this dull, as in the case of standard devices.

The demineralization of the water is carried out simply and safely by fitting between the instantaneous vaporizer (8) and the solenoid valve (10) a non-reusable demineralizing cartridge (15).

A conductivity meter (16), whose probe is positioned after the demineralizing cartridge, measures the increase in the water conductivity and the degeneration of the cartridge.

The owner is warned when the cartridge is exhausted, by a led which lights up on the electronic control panel (17) on the bottom face of the base (2) of the roof (1).

The user can easily and quickly replace the cartridge with a new one by opening the cup (18), housing the same, which is screwed on the bottom face of the base (2) of the roof (1).

If the cartridge is not replaced, the device will stop automatically.

Standard demineralizing cartridges normally available on the market are used.

For proper operation, the instantaneous vaporizer (8) requires a constant water supply flow being exactly equal to the quantity of water which can be vaporized by the power of its heating element, regardless of the variations of the water pressure in the mains.

Failure to provide these conditions could cause dangerous overheating of the vaporizer heating elements (8) or cause spurts of boiling water in the shower-box.

To resolve this problem the system of the device according to the invention is designed so as to convey small quantities of water to the instantaneous vaporizer.

For this purpose, a flow reducer (19) is installed after the solenoid valve (10), which reduces the supply flow.

If, the use of a flow reducer resolves the general problem, from a practical point of view this solution is not acceptable since firstly the passageway section of said reducer would be so small that it would plug very easily and, secondly, it would be extremely costly since it would be necessary to manufacture these reducers which provide very small constant flows as the mains pressure varies, as required for the instantaneous vaporizer (8), because they are not available on the market. This problem has been resolved by operating the solenoid valve (10) intermittently, by means of a timer (11).

Said solenoid valve (10) operates briefly at regular intervals and conveys small quantities of water to the instantaneous vaporizer (8) at regular intervals so as to avoid overheating of the heating elements and spurts of boiling water in the shower box.

A one-directional valve (20) is installed before the vaporizer (8) whose purpose is to protect the supply line from pressure variations which might be generated in the vaporizer (8).

The timer of the solenoid valve is interlocked to two standard thermostats (12 and 13), as shown in FIG. 5, in order to completely regulate the average water flow in the instantaneous vaporizer (8) according to its temperature.

The two thermostats (12 and 13) are installed on the walls of the vaporizer (8) and are set at different temperatures so as to intervene in successive phases.

Thermostat (12) is set at a temperature range within 125°-140° C., while thermostat (13) is set at a temperature of more than 140° C.

When the sauna-button is pressed on the control panel (17), the vaporizer (8) starts heating up automatically.

When its temperature reaches the range of thermostat (12), the latter activates the timer (11) and consequently the solenoid valve (10) will convey small quantities of water to the vaporizer (8) at suitable intervals.

The flow reducer (19) decreases the flow and keeps it constant regardless of pressure variations in the water mains.

Should the incoming water flow to the vaporizer (8) increase, the device automatically adjusts the same.

In fact, when the minimum temperature set on the thermostat (12) is reached, the same sends a signal to the timer (11) which stops the solenoid valve (10) until the temperature in the vaporizer (8) has returned within the ideal range, within which, as mentioned, the timer (11)

activates the solenoid valve (10) according to a first pre-established intermittent operating principle.

Vice-versa, a decrease in the flow of incoming water to the vaporizer (8) due to a lowering of the pressure in the water mains, would cause a rise of the temperature of the vaporizer (8) and if the temperature should exceed the minimum value of the thermostat setting (13), the same would automatically disactivate the first timing principle replacing it with a second having longer active opening times of the solenoid valve (10), so that more water can flow to the vaporizer and its temperature can return within the ideal operating range.

The system shown in FIG. 5 also has a dobble thermal safety device consisting of an automatic recharging thermostat (21) and by a thermal fuse (22) whose purpose is to protect the vaporizer from overheating, for example as in the case of an interruption of the water supply from the mains.

In this case the rise in temperature in the vaporizer (8) activates the automatic recharging thermostat (21) and simultaneously signals that the device has been stopped on the control panel (17).

The thermal fuse (22) acts as a double safety feature for thermal protection.

The operation of the device described above can be summarized as follows: by pressing the sauna-button on the electronic control panel (17) small quantities of water reach the vaporizer (8) at regular intervals, after passing through the demineralizing cartridge (15) and evaporate.

The probe of a conductivity meter (16) measures the conductivity of the water and if this exceeds a certain threshold on the electronic control panel (17), the led warning the owner to replace the demineralizing cartridge, lights up.

I claim:

1. A device for the production of steam for installing on a top of a standard shower box wherein said shower box includes a wail and top railing, the device comprising a compact box-shaped roof having a hollow lid and a bottom, the bottom being closed by a matching base platform, the box-shaped roof housing a steam production and forced air circulation system, the base platform of the box-shaped roof being smaller than the top of the shower box on which the box-shaped roof is installed, the base platform having a bottom face, a separate covering screen disposed on the top of the shower stall, the covering screen being sized and shaped to seal the top of the shower box which is not covered by the box-shaped roof, the base platform having therein an input opening and an output opening for the forced circulation of the steam.

2. A device for the production of steam for installing on a top of a standard shower box, according to claim 1, wherein the shape of a horizontal section of the roof is approximately that of an isosceles rectangular triangle and consists of the base and the hollow lid housing the steam production and forced air circulation system; an internal face of the base having two slots formed thereon, said slots corresponding to the respective input and output openings.

3. A device for the production of steam for installing on a top of a standard shower box, according to claim 1, further comprising a structural section adapted to be being fixed to the wall of the shower box, for forming, together with the top railing of the shower box, a perimeter support frame for the base of the box-shaped roof and for the screen; the structural section having end adjustment parts which permit adjusting the structural section with respect to the top of the shower box and the screen.

4. A device for the production of steam for installing on a top of a standard shower box, according to claim 1, further comprising a cup housing a demineralizing cartridge disposed within the box-shaped roof on the bottom face of the base platform.

5. A device for the production of steam for installing on a top of a standard shower box according to claim 1, wherein a control panel, for controlling operation of said steam production, is positioned on the bottom face of the base platform.

6. A device for the production of steam for installing on a top of a standard shower box according to claim 1, further comprising a suction fan, a channel mounted on the bottom face of the base platform and connecting two slots formed on the bottom face of the base platform, the suction fan being housed in the channel and circulating forced air therein, electrical heating elements for heating the air, and an instantaneous vaporizer with relative supply pipe, the suction fan, heating elements and vaporizer being preassembled and supported by the channel.

7. A device for the production of steam for installing on the roof of a standard shower box, the device comprising a compact box-shaped roof housing a steam production and forced air circulation system, and a covering screen, the covering screen having a size and shape to cover the surface of the roof of the shower box which is not covered by the box-shaped roof, the box-shaped roof having a base having an input opening and an output opening, for the forced circulation of the steam laden air, wherein the steam production device has an instantaneous vaporizer supplied directly from a source of water by means of a solenoid valve operated intermittently by a timer interlocked by two thermostats mounted on the vaporizer and set at different temperatures so as to intervene in successive phases; the timer being designed so as to activate the solenoid valve according to two different intermittent operating principles, having active phases of different duration.

8. A device for the production of steam for installing on the roof of a standard shower box according to claim 7, further comprising and connected in sequence, a solenoid valve, a flow reducer, a demineralizing cartridge and a conductivity meter for measuring the conductivity of the demineralized water coming out of the cartridge.

* * * * *